US006151904A

United States Patent [19]

Jin

[11] Patent Number: 6,151,904

[45] Date of Patent: Nov. 28, 2000

[54] AIR-JET SYSTEM FOR ANTI-SWEATING ON DISPLAY GLASS SURFACE

[75] Inventor: Zhihui Jin, Des Moines, Iowa

[73] Assignee: Kysor Industrial Corporation, Cadillac, Mich.

[21] Appl. No.: 09/263,449

[22] Filed: Mar. 5, 1999

[51] Int. Cl.[7] ..... A47F 3/04

[52] U.S. Cl. ..... 62/248; 454/198

[58] Field of Search ..... 62/248; 454/198, 454/123

[56] References Cited

U.S. PATENT DOCUMENTS

| | | | |
|---|---|---|---|
| 587,373 | 8/1897 | Parker et al. | 454/198 |
| 2,672,735 | 3/1954 | Fusselman | 62/248 |
| 3,025,681 | 3/1962 | Booth | 62/248 |
| 3,462,966 | 8/1969 | Reid et al. | 62/248 |
| 4,977,754 | 12/1990 | Upton et al. | 62/248 |
| 5,468,185 | 11/1995 | Truitt | 454/198 |
| 5,606,863 | 3/1997 | Kicklighter et al. | 62/89 |

*Primary Examiner*—William E. Tapolcai

*Attorney, Agent, or Firm*—Ohlandt, Greeley, Ruggiero & Perle, L.L.P.

[57] ABSTRACT

An air jet system is provided that includes a refrigerated display case. The novel apparatus includes a glass display window, which is transparent and has an outer surface for viewing the contents of the display case. The unit also has a front bar that defines an air passage therein when connected to a bracket and also defines a channel at one of its ends which has at least one opening. The bracket connects and supports the display window and the front bar on the display case. A nozzle is positioned in the channel and has holes therein for air passage and is positioned to direct air through the opening in the end of the front bar and onto the outer surface of the display window. A centrifugal blower is connected to the bracket and is adapted to blow air through the air passage and through the holes in the nozzle so that air is guided over the outer surface of the glass display window to eliminate moisture condensation.

20 Claims, 4 Drawing Sheets

AIR-JET SYSTEM FOR ANTI-SWEATING ON DISPLAY GLASS SURFACE

BACKGROUND OF THE INVENTION

This invention relates to refrigerated display cases, and more particularly to systems for eliminating moisture from glass display windows on refrigerated display cases.

Display cases for food items, such as those in delis and supermarkets, require refrigeration to keep the food fresh. Because cool air is required in the closed refrigerated display cases, moisture tends to condense and collect on the glass display window of the refrigerated case. That is, the windows tend to "sweat." In the past, moisture condensation has been prevented by circulating refrigerated air within the case where the moisture is picked up by the air and condensed on a refrigeration coil used to cool the air. For the exterior surface of the display window, heat was commonly used to remove or prevent condensation. However, this warmed the display window and required use of extra energy.

Another more recent method of preventing/removing condensation from the display window is shown in U.S. Pat. No. 5,606,863, which has the same Assignee as the present application. That invention used air propelling fans for propelling cooled air upwardly into the inside of the display case, and then through an opening in the top and out over the exterior of the front display window, as well as the inside of the display window, in a downward fashion. Some of the air is then recirculated back through the system to the air propulsion fan and back through the display case again.

SUMMARY OF THE INVENTION

An object of this invention is to provide an effective means of preventing or removing moisture condensation on the exterior of a display window on a refrigerated display case. The novel apparatus includes a glass display window which is transparent and has an outer surface for viewing the contents of the display case. The unit also has a front bar that defines an air passage therein when connected to a bracket and also defines a channel at one of its ends which has at least one opening. The bracket connects and supports the display window and the front bar on the display case. A nozzle is positioned in the channel and has holes therein for air passage, and is positioned to direct air through the opening in the end of the front bar and onto the outer surface of the display window. A centrifugal blower is connected to the bracket and is adapted to blow air through the air passage and through the holes in the nozzle so that air is guided over the outer surface of the glass display window to eliminate moisture condensation.

Another aspect of the present invention is a display case having a housing including a back, a bottom, a top, and a display window connected to the top and the bottom, and a centrifugal blower connected to and beneath the bottom of the housing where the blower has an air duct through which air is discharged. A front bar defining an air passage for directing air is attached to the end of the air duct and has a channel at one end. A nozzle is positioned in the channel of the front bar and has holes therein to direct air over the exterior of the display window of the display case to eliminate moisture build-up.

Yet another aspect of the present invention is an air jet system for eliminating moisture on a glass surface comprising a transparent glass display window having an outer surface. The air jet system further comprises a front bar defining a channel in one end thereof and having at least one opening in the end. The display window and front bar are connected by a bracket, which supports both, and the front bar and bracket define an air passage therebetween. A nozzle is positioned in the channel of the front bar, has holes for air flow, and is aligned to direct air through the opening in the front bar and onto the outer surface of the glass display window. A centrifugal blower is connected to the bracket and blows air through the air passage, through the holes in the nozzle, and over the outer surface of the display window to eliminate moisture thereon.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
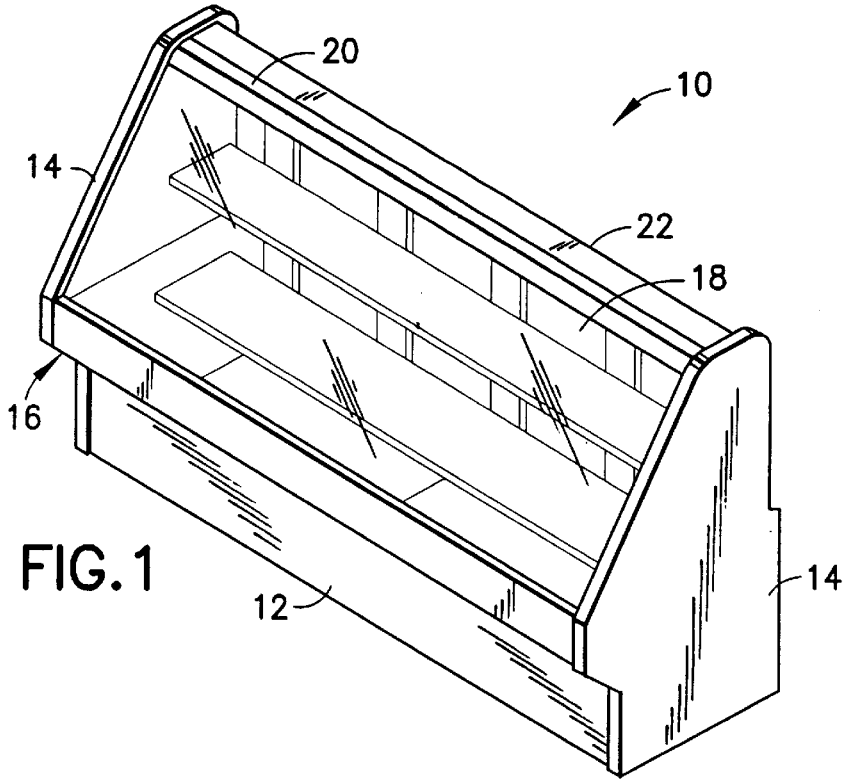
FIG. 1 is a perspective view of a display case employing the present invention.

Referring specifically to the drawings, a display case 10 is shown which is of the deli style. It includes a base 12, a pair of closed ends 14, a front portion 16 that includes a transparent glass window 18 that is used for the viewing of items inside display case 10 when it in use, a top portion 20, and a rear wall 22. Display window 18 is diagonally oriented and positioned between front portion 16 of the display case 10 and top portion 20. Top portion 20 is also connected to rear wall 22, which is connected to base 12. Display case 10 is shown to include two sets of shelves 24, 26, which are placed at various vertical heights in the display case.

Figure 2:
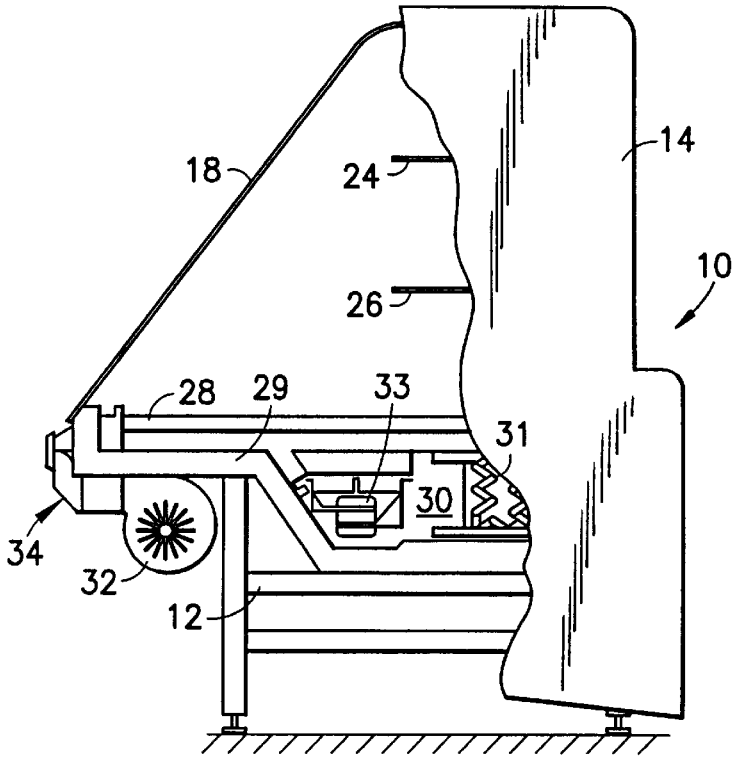
FIG. 2 is a partial cross-sectional view of the display case in FIG. 1.

As shown in FIG. 2, display case 10 also includes a bottom tray 28, and a display case bed 29. Bottom tray 28 and case bed 20 define an interior chamber 30 beneath bottom tray 28. Within chamber 30 are a refrigerator coil 31 and a cooling fan 33. Coil 31 and cooling fan 33 are used to cool the inside of display case 10 by blowing air over the coil 31 and into the inside of display case 10 where shelves 24 and 26 are located. An air jet system 34 is attached to the bottom of case bed 29 on the exterior of display case 10. Centrifugal blower is attached to case bed 29 by screws, bolts or other means of attachment.

Figure 3:
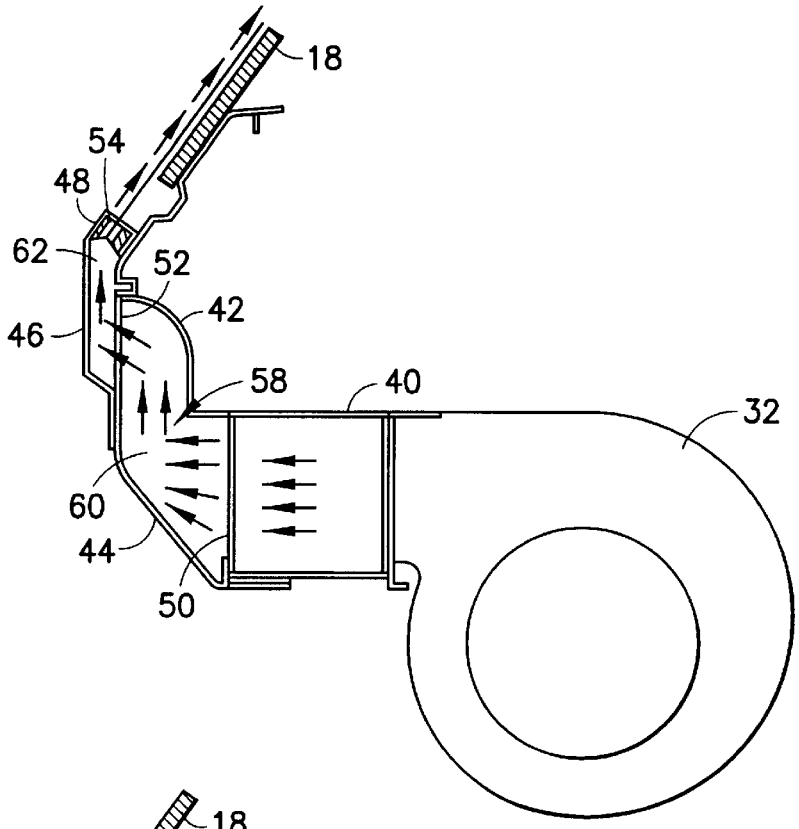
FIG. 3 is a fragmentary, cross-sectional view of the blower and front portion of the display case in FIGS. 1 and 2.
Figure 4:
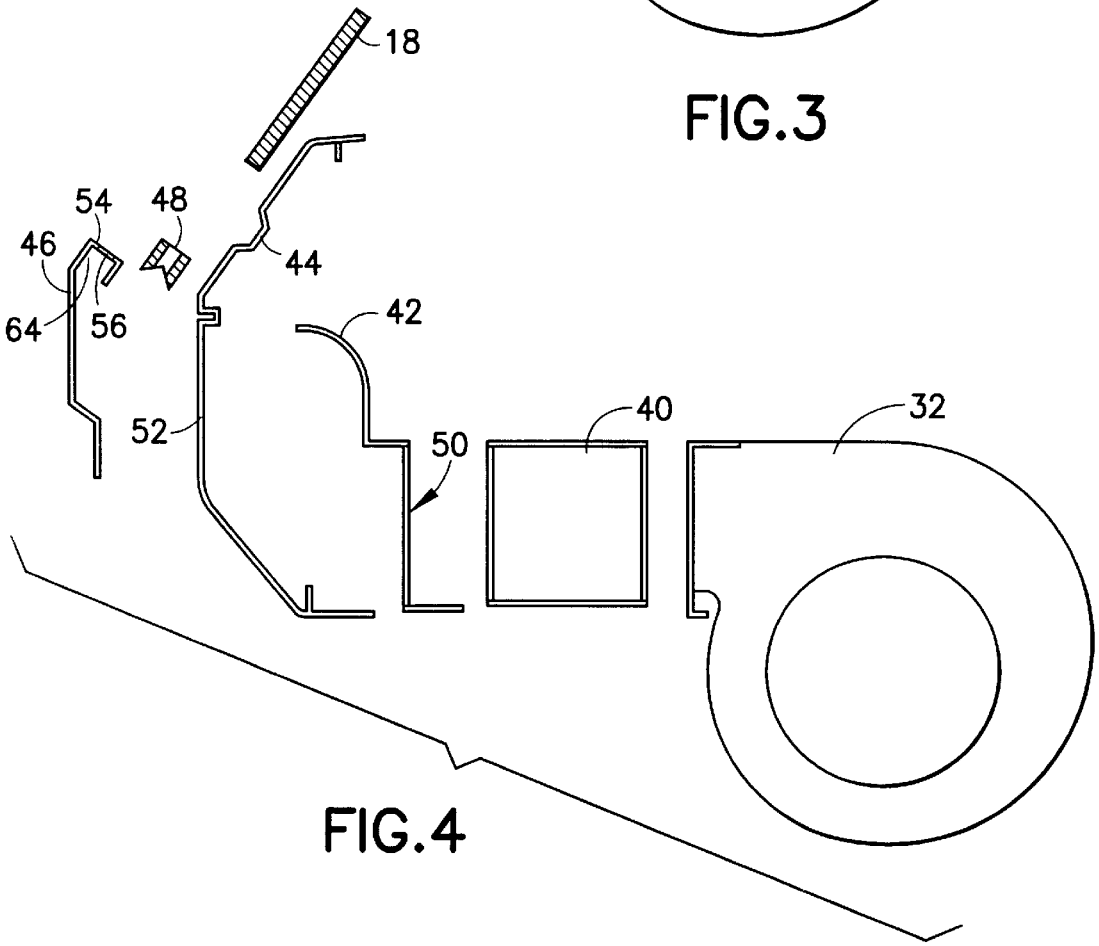
FIG. 4 is an exploded view of the blower and front portion of the display case in FIG. 3.

Referring now to FIGS. 3 and 4, air jet system 34 includes, in addition to centrifugal blower 32, inlets 35 disposed on blower 32, an air duct 40 which is a fitting for centrifugal blower 32, support 42, bracket 44, front bar 46, and nozzle 48. Inlets 35 allow air from outside of display case 10 to be drawn into blower 32. Air duct 40 is fitted over the end of centrifugal blower 32 and allows passage of air therethrough which exits from blower 32. Support 42 is connected to the end of air duct 40 opposite blower 32 and includes holes 50 therein to allow air flow therethrough. Bracket 44 is connected to support 42 and creates the shape of front portion 16. Bracket 44 also includes holes 52 to allow the flow of air therethrough. Front bar 46 is attached to the exterior of bracket 44, and includes end 54 which has a slot 56 or alternatively holes to allow air flow therethrough. The connection of centrifugal blower 32 with air duct 40, support 42, bracket 44, and front bar 46 creates an air passageway 58 to allow air to flow from centrifugal blower 32 all the way through the slot or holes 56 in the end 54 of front bar 46. The connection of support 42 and bracket 44 create an air channel 60 which feeds into an air pressure chamber 62 which is defined by front bar 46 on one side and bracket 44 on the other. At its end, front bar 46 has two bends approximately 90° each to define a channel 64. Channel 64 is provided along the entire width of display case 10. Nozzle 48 resides in channel 64 along its entire length or at least a substantial portion thereof.

Figure 6:
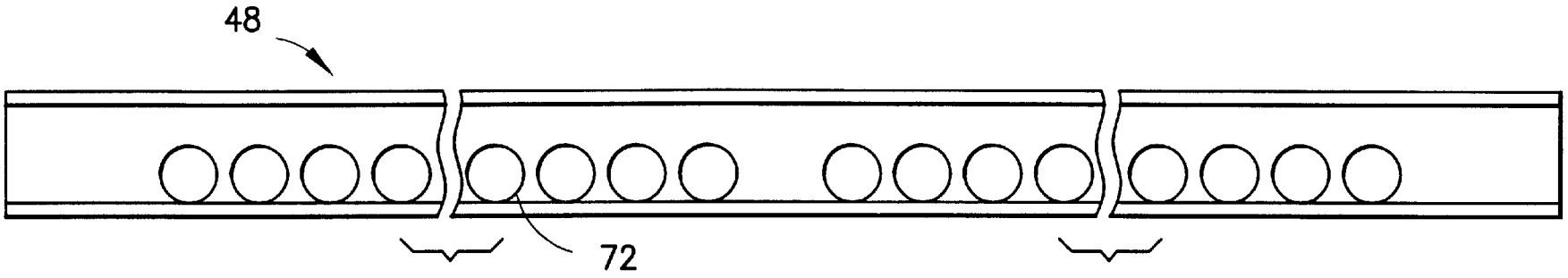
FIG. 6 is a fragmentary, enlarged view of the top of the nozzle portion of the display case in FIGS. 1 and 2.
Figure 7:
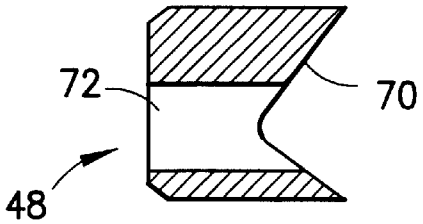
FIG. 7 is a fragmentary, enlarged elevational view of the nozzle.

Nozzle 48 is depicted in FIGS. 6 and 7. The front of nozzle 48 has a cutout portion 70 which is preferably 90°. Cutout portion 70 receives the air blown by centrifugal blower 32 and channels into a series of holes 72. The nozzle is preferably made of a polymeric substance such as polyvinylchloride (PVC) and all of its edges are preferably burr free. Holes 72 line nozzle 48, the holes having a depth H and a diameter D. Preferably, the ratio of H/D is equal to or greater than about 1 to provide the most effective air flow to remove or prevent moisture build-up on a glass surface. In addition, the inside surface roughness of the holes should be 125 $\mu$-in or less. As shown in FIG. 3, the center lines of holes 72 are preferably parallel with glass display window 18 (along its length dimension from bottom to top). This configuration gives the most effective moisture removal from display window 18.

The display case 10 uses a single centrifugal blower which can provide 370 cubic feet per minute (cfm) of air at 0 static pressure for preferably a maximum width of 4 feet of the display case. Twin blowers providing a total of 550 cfm at 0 static pressure are preferably provided for display cases having a width greater than 4 feet up to a maximum of 8 feet in width. In a 6-foot display case for example, the air velocity range with twin blowers is preferably at least 2,000 feet per minute (fpm) and preferably about 2700–2900 fpm at the exit of the nozzle holes 72 and greater than 600 fpm at 30 inches past the nozzle holes 72 along the glass surface display window 18. The velocity of the air may vary depending on the length of display window 18. However, the average air velocity over display window 18 is preferably about 2500 fpm. Centrifugal blower 32 includes a wheel, a pressure-conversion housing, and a motor. The arrows in FIG. 3 show the direction of the air flow from centrifugal blower 32 through air duct 40, through air channel 60, through air pressure chamber 62, and ultimately through the holes 72 in nozzle 48.

Figure 5:
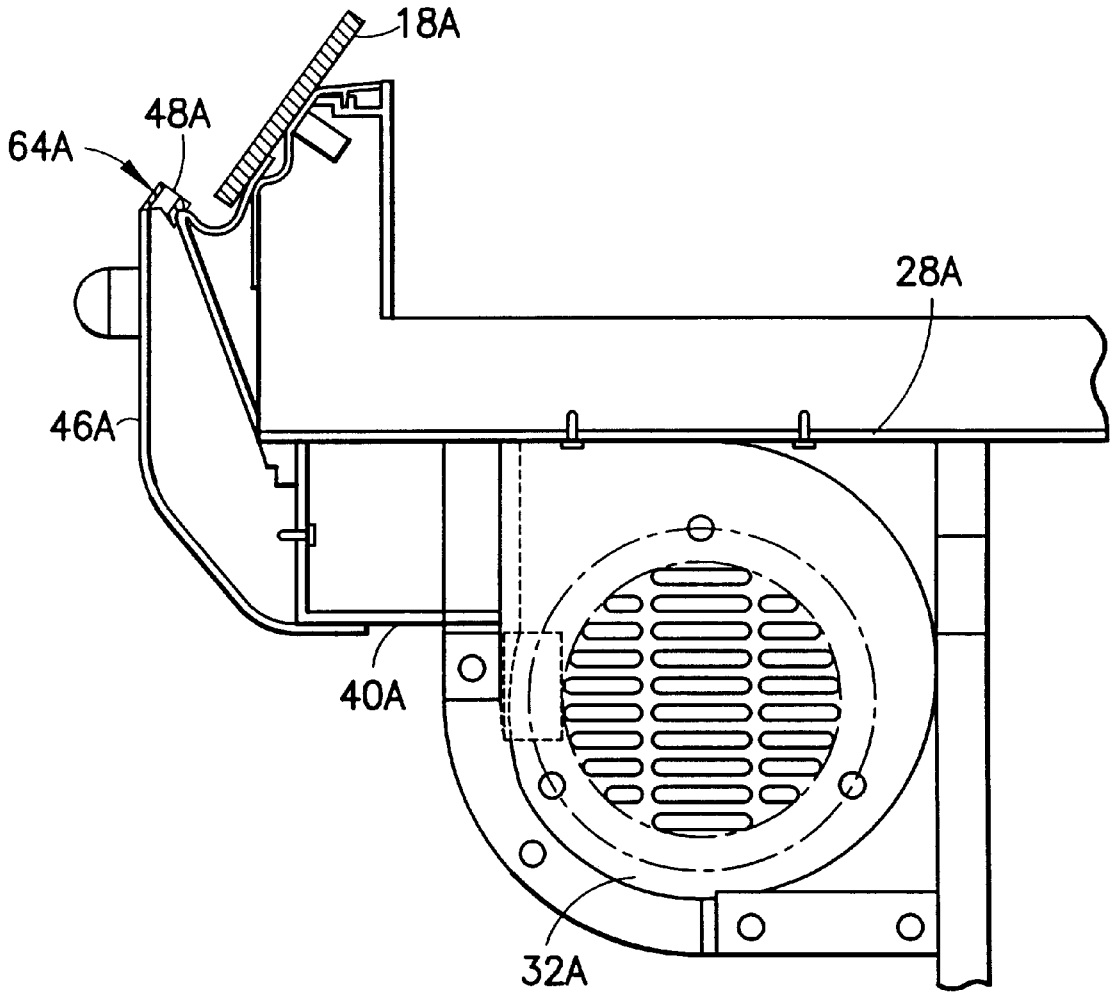
FIG. 5 is a fragmentary, cross-sectional view of an alternate embodiment of the blower and front portion of the display case in FIGS. 1 and 2.

FIG. 5 is an alternate embodiment of the present invention, which includes a front bar 46A which is extruded and provides a different shape than that of the previously described embodiment. Extruded front bar 46A includes a channel 64A where nozzle 48A sits. The extruded embodiment, including front bar 46A, provides an alternative method for producing the front bar of the invention and is designed to provide the same air jetting as in the prior embodiment.

In operation, centrifugal blower 32 is started, which sucks in air through inlets 35 from outside of display case 10. The air is then rotated and accelerated by a rotating wheel and is propelled out of centrifugal blower 32, through air duct 40, through air channel 58, through air pressure chamber 62, and through holes 72 in nozzle 48. This air is directed by holes 72 over display window 18 to prevent or remove moisture condensation on the exterior surface of the display window. Holes 72 are shaped and positioned so that the air stream exiting the holes will not reach a height over two inches above display window 18 for at least 24 inches, and for preferably at least 30 inches. This provides greater effectiveness for moisture removal from display window 18.

The display case and air jet system, as described above, provide a novel and effective means for removing and/or preventing moisture build-up on the display window of a refrigerated case. The centrifugal blower provides a high pressure, high velocity air flow which, when used with the air passageway and nozzle described above, provides an air flow along the glass surface of the display case which reaches only a limited height above the glass display window surface and thereby provides an effective way to prevent moisture build-up on the surface.

The above description is considered that of the preferred embodiments only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

What is claimed is:

1. A display case comprising:

a housing having a back, a bottom, a top, a front, and a display window at said front between said top and said bottom;

a centrifugal blower at said bottom of said housing, said centrifugal blower having air inlets for drawing air from the exterior of said housing and having an air duct through which air is discharged, said air duct having an end portion;

an enclosure defining an air passage for directing air, attached to said end of said air duct and having a channel; and an elongated nozzle in said channel of said enclosure, said nozzle adapted to receive air flowing through said air channel and having air discharge openings therein to direct air at a high velocity over said display window of the display case to eliminate moisture buildup.

2. The display case defined in claim 1 wherein said elongated nozzle is oriented to direct air in a direction parallel to said display window.

3. The display case defined in claim 2 and further comprising a second centrifugal blower at said bottom of said housing of the display case.

4. The display case defined in claim 3 wherein said centrifugal blower provides an air flow of at least 550 cfm.

5. The display case defined in claim 4 wherein said centrifugal blower provides an air velocity of at least 2000 fpm at the elongated nozzle.

6. The display case defined in claim 1 wherein said centrifugal blower provides an air flow of at least 550 cfm.

7. The display case defined in claim 1 wherein said centrifugal blower provides an air velocity of at least 2000 fpm at the elongated nozzle.

8. The display case defined in claim 1 and further comprising a second centrifugal blower at said bottom of said housing of the display case.

9. A refrigerated display case comprising:

a housing having a front, a back, a top and a case bed having a bottom, said front having a display window with an outer surface;

a centrifugal blower beneath said case bed positioned to draw air from the exterior of said housing and positioned to blow air toward said front of said housing;

an elongated nozzle having at least one air discharge opening through it to direct air, connected to said centrifugal blower by an air duct;

said elongated nozzle positioned to direct air along said display window outer surface.

10. The refrigerated display case defined in claim 9 wherein said at least one air discharge opening in said elongated nozzle has a longitudinal axis that is parallel to the length dimension of said display window.

11. The refrigerated display case defined in claim 10 wherein said at least one nozzle air discharge opening is configured to direct air along the surface of said display window and the air discharged through said at least one air discharge opening does not extend higher than 2 inches above the surface of said display window for at least 24 inches in length of said display window.

12. The refrigerated display case defined in claim 11 wherein said at least one nozzle air discharge opening has a depth H and a diameter D and the ratio of H/D is at least about 1.

13. The refrigerated display case defined in claim 9 and further comprising a second centrifugal blower beneath said case bed to provide increased airflow.

14. An air jet system for eliminating moisture on a glass surface, the air jet system comprising:

a transparent glass display window having an outer surface disposed within a housing;

a front bar defining a channel at one end thereof and having at least one opening in said end where said housing is defined;

a bracket connected to and supporting said glass display window and supporting said front bar, said front bar and said bracket defining an air passageway therebetween;

an elongated nozzle positioned in said channel of said front bar having holes therein for air flow therethrough and aligned to direct air through said at least one opening in said front bar and onto said outer surface of said glass display window;

a centrifugal blower connected to said bracket, adapted to draw air from the exterior of said housing and adapted to blow air through said air passageway, through said holes in said nozzle, through said at least one opening in said front bar and over said outer surface of said glass display window to eliminate moisture thereon.

15. The air jet system of claim 14 wherein said nozzle holes each have a longitudinal axis that is parallel to the length dimension of said display window.

16. The air jet system of claim 15 wherein said nozzle holes have a depth H and a diameter D and the ratio of H/D is at least about 1.

17. The air jet system of claim 16 wherein said nozzle holes are configured to direct air along said display window and the air discharged through said holes does not reach higher than 2 inches above said display window for at least 24 inches in length of said display window.

18. A method of eliminating moisture buildup on a display window of a refrigerated display case comprising the steps of:

providing a refrigerated display case with a housing having a display window;

providing a centrifugal blower beneath said housing, and an elongated nozzle connected by a duct to said blower;

causing air to be drawn into said centrifugal blower from the exterior of said housing; and causing air to be discharged from said centrifugal blower, through said duct, through said elongated nozzle, and over said display window to thereby prevent condensation on said display window.

19. The method of eliminating moisture build-up on a display window defined in claim 18 wherein said centrifugal blower causes air to be discharged at a velocity of at least 2000 fpm at said elongated nozzle.

20. The method of eliminating moisture build-up on a display window defined in claim 18 wherein said nozzle comprises at least one air discharge opening which has a longitudinal axis parallel to the length dimension of said display window.

* * * * *